US007473190B2

(12) United States Patent
Hocknell et al.

(10) Patent No.: US 7,473,190 B2
(45) **Date of Patent: *Jan. 6, 2009**

(54) IRON GOLF CLUB WITH NANOCRYSTALLINE FACE INSERT

(75) Inventors: Alan Hocknell, Carlsbad, CA (US); Chris J. Wieland, Vista, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/133,652

(22) Filed: Jun. 5, 2008

(65) Prior Publication Data

US 2008/0242446 A1 Oct. 2, 2008

Related U.S. Application Data

(63) Continuation of application No. 11/828,485, filed on Jul. 26, 2007, now Pat. No. 7,399,238, which is a continuation-in-part of application No. 11/751,509, filed on May 21, 2007, now Pat. No. 7,338,389, which is a continuation of application No. 10/906,468, filed on Feb. 22, 2005, now Pat. No. 7,220,189, which is a continuation of application No. 10/605,535, filed on Oct. 6, 2003, now Pat. No. 6,857,973, which is a continuation-in-part of application No. 10/604,520, filed on Jul. 28, 2003, now Pat. No. 6,863,625, which is a continuation-in-part of application No. 10/065,147, filed on Sep. 20, 2002, now Pat. No. 6,769,998.

(51) Int. Cl.
*A63B 53/04* (2006.01)

(52) U.S. Cl. ..... 473/342; 473/347; 473/349; 473/350

(58) Field of Classification Search ..... 473/324–350, 473/287–292, 305–315
See application file for complete search history.

(56) References Cited

U.S. PATENT DOCUMENTS

| | | | |
|---|---|---|---|
| 4,664,383 | A | 5/1987 | Aizawa et al. |
| 4,667,963 | A | 5/1987 | Yoneyama |
| 4,792,139 | A | 12/1988 | Nagasaki et al. |
| 4,798,383 | A | 1/1989 | Nagasaki et al. |
| 4,848,747 | A | 7/1989 | Fukimura et al. |
| 4,884,812 | A | 12/1989 | Nagasaki et al. |
| 4,928,972 | A | 5/1990 | Nakanisi et al. |
| 4,964,640 | A | 10/1990 | Nakanisi et al. |
| 5,120,062 | A | 6/1992 | Scheie et al. |
| 5,190,290 | A | 3/1993 | Take |
| 5,228,694 | A | 7/1993 | Okumoto et al. |
| D347,254 | S | 5/1994 | Linuma |
| 5,326,106 | A | 7/1994 | Meyer |

(Continued)

*Primary Examiner*—Sebastiano Passaniti
(74) *Attorney, Agent, or Firm*—Michael A. Catania; Elaine H. Lo

(57) ABSTRACT

The iron golf club head (20) of the present invention is preferably composed of three main components: a periphery member 22, a central member 24 and a nanocrystalline plated face plate 26. The periphery member (22) is preferably composed of a high density material such as a nickel-tungsten alloy. The central member (24) is preferably composed of a lightweight, non-metal material. The face plate (26) is preferably composed of a non-metal material plated with a nanocrystalline material. The iron golf club head (20) preferably has high moments of inertia Izz and Ixx.

10 Claims, 7 Drawing Sheets

U.S. PATENT DOCUMENTS

| | | | | |
|---|---|---|---|---|
| 5,333,872 | A | 8/1994 | Manning et al. | |
| D353,644 | S | 12/1994 | Hirsch | |
| 5,375,840 | A | 12/1994 | Hirsch et al. | |
| D354,786 | S | 1/1995 | Manning et al. | |
| 5,411,264 | A | 5/1995 | Oku | |
| 5,423,546 | A | 6/1995 | Manning et al. | |
| 5,433,797 | A | 7/1995 | Erb et al. | |
| 5,472,201 | A | 12/1995 | Aizawa et al. | |
| D366,082 | S | 1/1996 | Dekura | |
| 5,497,995 | A | 3/1996 | Swisshelm | |
| D368,756 | S | 4/1996 | Blough et al. | |
| D368,947 | S | 4/1996 | Blough et al. | |
| 5,547,194 | A | 8/1996 | Aizawa et al. | |
| 5,589,011 | A | 12/1996 | Gonsalves | |
| 5,595,552 | A | 1/1997 | Wright et al. | |
| 5,617,004 | A | 4/1997 | Kaneko | |
| 5,675,233 | A | 10/1997 | Kaneko et al. | |
| 5,850,136 | A | 12/1998 | Kaneko | |
| 5,984,996 | A | 11/1999 | Gonsalves et al. | |
| 6,033,624 | A | 3/2000 | Gonsalves et al. | |
| 6,051,046 | A | 4/2000 | Schulz et al. | |
| 6,080,504 | A | 6/2000 | Taylor et al. | |
| 6,129,795 | A | 10/2000 | Lehockey et al. | |
| 6,200,450 | B1 | 3/2001 | Hui | |
| 6,277,170 | B1 | 8/2001 | Schulz et al. | |
| 6,277,326 | B1 | 8/2001 | Deshmukh et al. | |
| 6,342,110 | B1 | 1/2002 | Palumbo | |
| 6,344,097 | B1 | 2/2002 | Limoges et al. | |
| D464,387 | S | 10/2002 | Rollinson et al. | |
| D464,693 | S | 10/2002 | Rollinson et al. | |
| D474,822 | S | 5/2003 | Cleveland et al. | |
| 6,589,298 | B1 | 7/2003 | Limoges et al. | |
| 6,592,686 | B2 | 7/2003 | Palumbo | |
| 6,679,788 | B1 * | 1/2004 | Heinrich et al. | 473/324 |
| 6,769,998 | B2 * | 8/2004 | Clausen et al. | 473/324 |
| 6,802,917 | B1 | 10/2004 | Tomantschger et al. | |
| 6,814,674 | B2 * | 11/2004 | Clausen et al. | 473/342 |
| 6,857,973 | B2 * | 2/2005 | Wieland et al. | 473/342 |
| 6,863,625 | B2 * | 3/2005 | Reyes et al. | 473/342 |
| 6,887,164 | B2 * | 5/2005 | Dewanjee et al. | 473/342 |
| 7,004,853 | B2 * | 2/2006 | Deshmukh | 473/332 |
| 7,063,628 | B2 | 6/2006 | Reyes et al. | |
| 7,087,268 | B2 | 8/2006 | Byrne et al. | |
| 7,144,336 | B2 * | 12/2006 | Reyes et al. | 473/342 |
| 7,220,189 | B2 * | 5/2007 | Wieland et al. | 473/342 |
| 7,250,008 | B2 * | 7/2007 | Dewanjee et al. | 473/342 |
| 7,320,832 | B2 | 1/2008 | Palumbo et al. | |
| 7,354,354 | B2 | 4/2008 | Palumbo et al. | |
| 7,387,578 | B2 | 6/2008 | Palumbo et al. | |
| 7,399,238 | B2 * | 7/2008 | Hocknell et al. | 473/342 |
| 7,438,647 | B1 * | 10/2008 | Hocknell | 473/334 |
| 2002/0050311 | A1 | 5/2002 | Palumbo | |
| 2005/0205425 | A1 | 9/2005 | Palumbo et al. | |
| 2006/0135281 | A1 | 6/2006 | Palumbo et al. | |
| 2006/0135282 | A1 | 6/2006 | Palumbo et al. | |
| 2006/0292388 | A1 | 12/2006 | Palumbo et al. | |

* cited by examiner

IRON GOLF CLUB WITH NANOCRYSTALLINE FACE INSERT

CROSS REFERENCES TO RELATED APPLICATIONS

The present application is a continuation application of U.S. patent application Ser. No. 11/828,485, filed on Jul. 26, 2007, which is a continuation-in-part application of U.S. patent application Ser. No. 11/751,509, filed on May 21, 2007, which is a continuation of U.S. patent application Ser. No. 10/906,468, filed on Feb. 22, 2005, now U.S. Pat. No. 7,220,189, which is a continuation of U.S. patent application Ser. No. 10/605,535, filed on Oct. 6, 2003, now U.S. Pat. No. 6,857,973, which is a continuation-in-part application of U.S. patent application Ser. No. 10/604,520, filed on Jul. 28, 2003, now U.S. Pat. No. 6,863,625, which is a continuation-in-part application of U.S. patent application Ser. No. 10/065,147, filed on Sep. 20, 2002, now U.S. Pat. No. 6,769,998.

STATEMENT REGARDING FEDERALLY SPONSORED RESEARCH OR DEVELOPMENT

Not Applicable

BACKGROUND OF THE INVENTION

1. Field of the Invention

The present invention relates to an iron golf club. More specifically, the present invention relates to a multiple material iron golf club with a face insert composed of a nanocrystalline plated material.

2. Description of the Related Art

Irons are typically composed of a stainless steel or titanium material, and are typically cast or forged. Most golfers desire that their irons have a large sweet spot for greater forgiveness, a low center of gravity to get the ball in the air, a solid sound, reduced vibrations during impact, and a trim top line for appearance. Unfortunately, these desires are often in conflict with each other as it pertains to an iron.

The use of iron club heads composed of different materials has allowed some prior art irons to achieve some of these desires.

One example is U.S. Pat. No. 5,228,694 to Okumoto et al., which discloses an iron club head composed of a stainless steel sole and hosel, a core composed of a bulk molding compound or the like, a weight composed of a tungsten and polyamide resin, and an outer-shell composed of a fiber-reinforced resin.

Another example is set forth in U.S. Pat. Nos. 4,792,139, 4,798,383, 4,792,139 and 4,884,812, all to Nagasaki et al., which disclose an iron club head composed of stainless steel with a fiber reinforced plastic back plate to allow for weight adjustment and ideal inertia moment adjustment.

Another example is U.S. Pat. No. 4,848,747 to Fujimura et al., which discloses a metal iron club head with a carbon fiber reinforced plastic back plate to increase the sweet spot. A ring is used to fix the position of the back plate.

Another example is set forth in U.S. Pat. Nos. 4,928,972 and 4,964,640 to Nakanishi et al., which disclose an iron club head composed of stainless steel with a fiber reinforcement in a rear recess to provide a dampening means for shock and vibrations, a means for increasing the inertial moment, a means for adjusting the center of gravity and a means for reinforcing the back plate.

Another example is U.S. Pat. No. 5,190,290 to Take, which discloses an iron club head with a metal body, a filling member composed of a light weight material such as a plastic, and a fiber-reinforced resin molded on the metal body and the filling member.

Another example is U.S. Pat. No. 5,411,264 to Oku, which discloses a metal body with a backwardly extended flange and an elastic fiber face plate in order to increase the moment of inertia and minimize head vibrations.

Another example is U.S. Pat. No. 5,472,201 to Aizawa et al., which discloses an iron club head with a body composed of stainless steel, a face member composed of a fiber reinforced resin and a protective layer composed of a metal, in order to provide a deep center of gravity and reduce shocks.

Another example is U.S. Pat. No. 5,326,106 to Meyer, which discloses an iron golf club head with a metal blade portion and hosel composed of a lightweight material such as a fiber reinforced resin.

Another example is U.S. Pat. No. 4,664,383 to Aizawa et al., which discloses an iron golf club head with a metal core covered with multiple layers of a reinforced synthetic resin in order to provide greater ball hitting distance.

Another example is U.S. Pat. No. 4,667,963 to Yoneyama, which discloses an iron golf club head with a metal sole and a filling member composed of a fiber reinforced resins material in order to provide greater hitting distance.

Nanocrystalline or nanophase technology originated a number of decades ago. The technology has progressed since its origin and application of the technology to various goods have been explored and documented by numerous individuals.

One of the earliest patents for this technology is U.S. Pat. No. 5,433,797 to Erb et al., for a Nanocrystalline Metals. This patent discloses a process for producing nickel-iron alloy nanocrystalline metals having a grain size of less than eleven nanometers.

U.S. Pat. No. 6,051,046 to Schulz et al., and U.S. Pat. No. 6,277,170 to Schulz et al., both for Nanocrystalline Ni-Based Alloys, disclose nanocrystalline nickel based alloys having grain sizes less than 100 nanometers.

U.S. Pat. No. 6,200,450 to Hui, for a Method and Apparatus for Depositing Ni—Fe—W-Palloys, discloses electrodepositing a nickel-iron-tungsten phosphorous alloy to promote wear resistance.

U.S. Pat. No. 6,080,504 to Taylor et al., for Electrodeposition of Catalytic Metals Using Pulsed Electric Fields, discloses a method for forming nanocrystalline metals on a substrate.

U.S. Pat. No. 5,589,011 to Gonsalves for a Nanostructured Steel Alloy, discloses a steel powder having a grain size in the nanometer range, specifically in the 50 nanometer size, and the steel power is an alloy composed of iron, chromium, molybdenum, vanadium and carbon.

U.S. Pat. No. 5,984,996 to Gonsalves et al., for Nanostructured Metals, Metal Carbides, and Metal Alloys, discloses nanostructured steel, aluminum, aluminum oxide, aluminum nitride, and other metals having crystallite size ranging from 45 nanometers to 75 nanometers.

U.S. Pat. No. 6,033,624 to Gonsalves et al., for Methods for the Manufacturing of Nanostructured Metals, Metal Carbides, and Metal Alloys, discloses a chemical synthesis method for producing nanostructured metals.

U.S. Pat. No. 5,603,667 to Ezaki et al., discloses an iron with a striking face composed of copper or a copper alloy and nickel plated.

U.S. Pat. No. 5,207,427 to Saeki discloses an iron with an non-electrolytic nickel-boron plating and a chromate film, and a method for manufacturing such an iron.

U.S. Pat. No. 5,792,004 to Nagamoto discloses an iron composed of a soft-iron material with a carbonized surface layer.

U.S. Pat. No. 5,131,986 to Harada et al., discloses a method for manufacturing a golf club head by electrolytic deposition of metal alloys such as nickel based alloys.

U.S. Pat. No. 6,193,614 to Sasamoto et al., discloses a golf club head with a face portion that is arranged to have its crystal grains of the material of the face portion oriented in a vertical direction. The '614 patent also discloses nickel-plating of the face portion.

U.S. Pat. No. 5,531,444 to Buettner discloses an iron composed of a ferrous material having a titanium nitride coating for wear resistance.

U.S. Pat. No. 5,851,158 to Winrow et al., discloses a golf club head with a coating formed by a high velocity thermal spray process.

U.S. Pat. No. 7,087,268 to Byrne et al., for a Method Of Plating A Golf Club head discloses a method of plating a golf club head composed of magnesium, magnesium alloys, aluminum, or aluminum alloys.

U.S. Pat. No. 7,063,628 to Reyes et al., for a Plated Magnesium Golf Club Head discloses a golf club head having a magnesium portion that is plated with a nickel or nickel alloy based material.

U.S. Patent Publication 2006/0135281 to Palumbo et al., for a Strong, Lightweight Article Containing A Fine-Grained Metallic Layer discloses a shaft or face plate that is plated on a single surface with a nanocrystalline material.

The prior art has failed to disclose a nanocrystalline plated material for a face insert for a multiple material iron golf club head.

BRIEF SUMMARY OF THE INVENTION

One aspect of the present invention is an iron golf club head including a periphery member, a central member and a face insert. The periphery member is composed of a metal material having a density between 8 g/cm$^3$ and 12 g/cm$^3$. The periphery member has a volume percentage of the golf club head ranging from 15% to 50%, and a mass percentage of the golf club head ranging from 50% to 80%. The periphery member also defines an opening. The central member is disposed in the opening of the periphery member. The central member is composed of a first non-metal material and has a volume percentage of the golf club head ranging from 25% to 75%, and a mass percentage of the golf club head ranging from 10% to 30%. The face insert is composed of a second non-metal material with a nanocrystalline plating deposited on an exterior surface of the face insert. The second non-metal material has a lower density than the metal material. The face insert is mounted in the opening of the periphery member and disposed over the central member. The face insert has a thickness between 0.040 inch and 0.250 inch. The golf club head has a total volume ranging from 40 cm$^3$ to 60 cm$^3$.

The metal material is preferably composed of a nickel-tungsten alloy, a nickel-iron-molybdenum alloy or a nickel-iron-chromium alloy. The nanocrystalline plating preferably has a thickness ranging from 20 microns to 2000 microns. The second non-metal material is preferably a nylon material, a composite material, plies of pre-preg, a polycarbonate material or a polyurethane material.

Another aspect of the present invention is an iron golf club head including a periphery member, a central member and a face insert composed of a non-metal material with a nanocrystalline plating. The periphery member is composed of a first metal material having a density between 8 g/cm$^3$ and 12 g/cm$^3$. The periphery member has a mass that ranges from 100 grams to 240 grams. The central member is disposed in an opening of the periphery member. The central member is composed of a first non-metal material. The central member has a mass that ranges from 9 grams to 70 grams. The nanocrystalline plated face insert is mounted in the opening of the periphery member and disposed over the central member. The face insert has a thickness between 0.040 inch and 0.250 inch. The iron golf club head has a mass that ranges from 235 grams to 300 grams and the golf club head has a total volume ranging from 40 cm$^3$ to 60 cm$^3$.

Yet another aspect of the present invention is an iron golf club head with a nanocrystalline plated face insert, a high-density periphery member and a low-density central member. The periphery member is composed of a first metal material having a density between 8 g/cm$^3$ and 12 g/cm$^3$. The periphery member has a mass that ranges from 100 grams to 240 grams. The central member is disposed in an opening of the periphery member. The central member is composed of a non-metal material. The central member has a mass that ranges from 9 grams to 70 grams. The nanocrystalline plated face insert is composed of a second non-metal material with a nanocrystalline plating deposited on an exterior surface of the face insert and an interior surface of the face insert. The second non-metal material has a lower density than the metal material. The face insert is mounted in the opening of the periphery member and disposed over the central member. The face insert has a thickness between 0.040 inch and 0.250 inch. The iron golf club head has a mass that ranges from 235 grams to 300 grams and the golf club head has a total volume ranging from 40 cm$^3$ to 60 cm$^3$.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
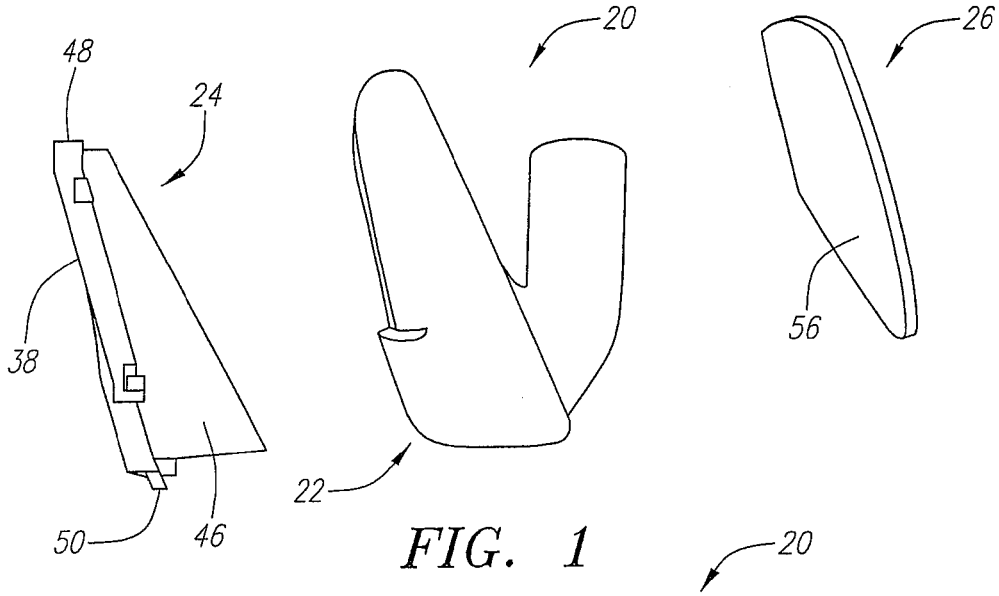
FIG. 1 is an exploded view of an iron club head of a preferred embodiment of the present invention.
Figure 2A:
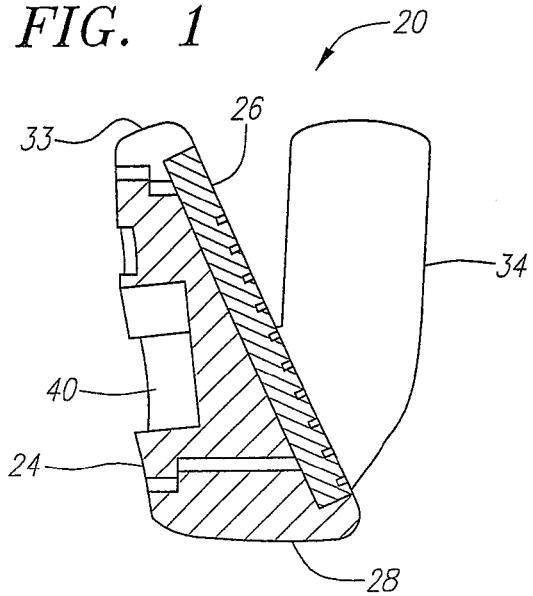
FIG. 2A is a cross-sectional view of the iron golf club head of FIG. 2 along lines A-A.
Figure 2:
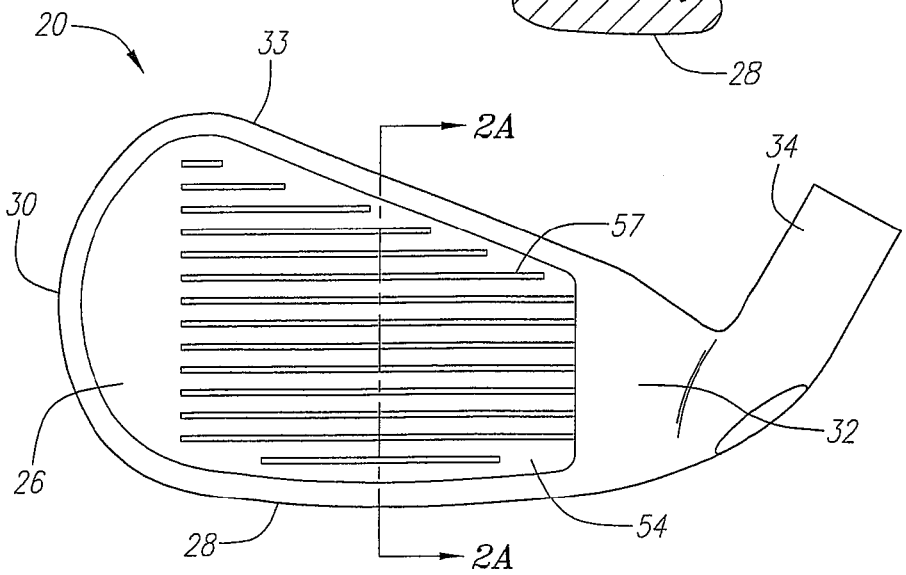
FIG. 2 is a front plan view of an iron club head.
Figure 3:
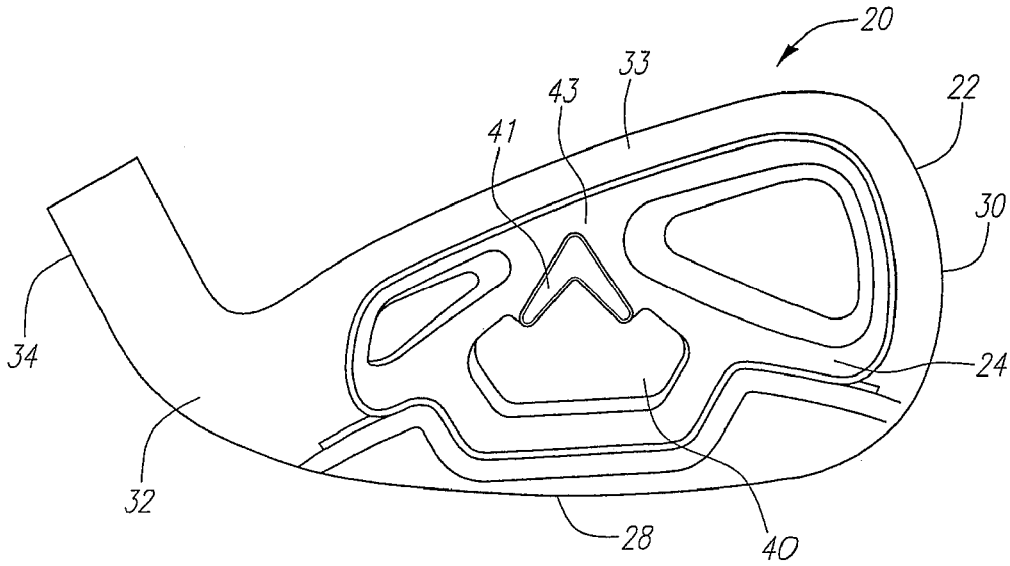
FIG. 3 is a rear plan view of an iron club head.

As shown in FIGS. 1-8, an iron golf club head in accordance with the present invention is generally designated 20. The club head 20 is preferably composed of three main components: a periphery member 22, a central member 24 and a face plate 26. The club head 20 can range from a 1-iron to a lob-wedge, with the loft angle preferably ranging from fifteen degrees to sixty degrees, and a lie angle preferably ranging from fifty-nine to sixty-five degrees. The three main components are assembled into the club head 20 using a process such as disclosed in co-pending U.S. patent application Ser. No. 10/065,150, filed on Sep. 20, 2002, entitled Method For Manufacturing Iron Golf Club Head, which is hereby incorporated by reference in its entirety.

The periphery member 22 is preferably composed of a material having a density greater than 7.86 grams per centimeter cubed ("g/cm$^3$"). A preferred material is an iron-nickel-tungsten alloy having a density preferably ranging from 8.0 g/cm$^3$ to 12.0 g/cm$^3$, more preferably ranging from 9.0 g/cm$^3$ to 10.5 g/cm$^3$, most preferably 9.3 g/cm$^3$. Another preferred material is a nickel-tungsten alloy disclosed in U.S. Pat. No. 7,004,853, entitled High Density Alloy for Improved Mass Properties of an Article, which is hereby incorporated by reference in its entirety. The preferred nickel-tungsten alloy includes at least 50 weight percent nickel, at least 20 weight percent tungsten and at least 20 weight percent chromium and has a density in the range of 9.0 g/cm$^3$ to 10.5 g/cm$^3$. Another alternative material is a stainless steel material. Still another material is disclosed in U.S. Pat. No. 6,277,326, entitled Process for Liquid-Phase Sintering of a Multiple-Component Material, which is hereby incorporated by reference in its entirety. Those skilled in the pertinent art will recognize that still other materials may be used for the periphery member 22 without departing from the scope and spirit of the present invention. A preferred method for forming the periphery member 22 is through investment casting.

The periphery member 22 has a sole wall 28, a toe wall 30, a heel wall 32, a top wall 33, and a hosel 34 with a bore 36 for receiving a shaft. The top wall 33, sole wall 28, toe wall 30 and heel wall 32 define an opening 37 through the periphery member 22. The bore 36 preferably extends through the entire hosel 34 providing a short straight hollow hosel such as disclosed in U.S. Pat. No. 4,995,609, which pertinent parts are hereby incorporated by reference.

Figure 6:
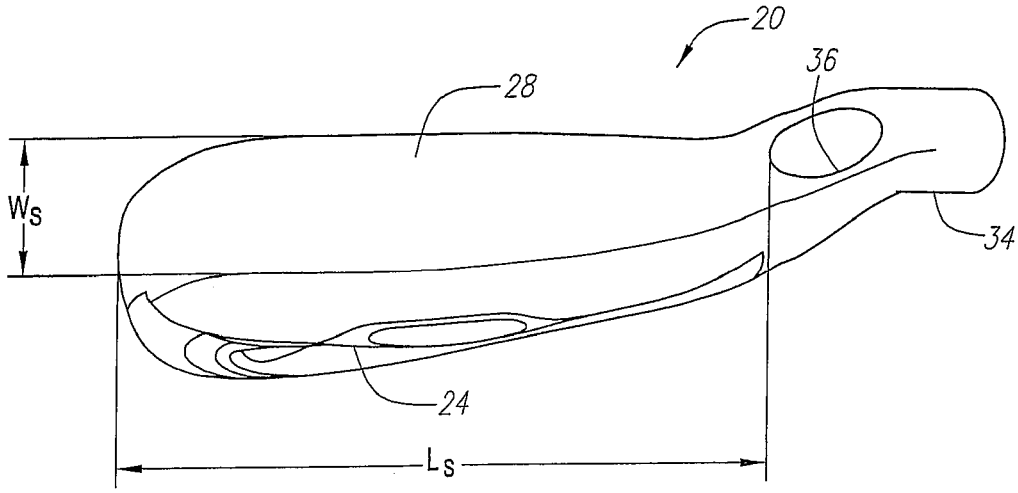
FIG. 6 is a bottom plan view of an iron club head.
Figure 7:
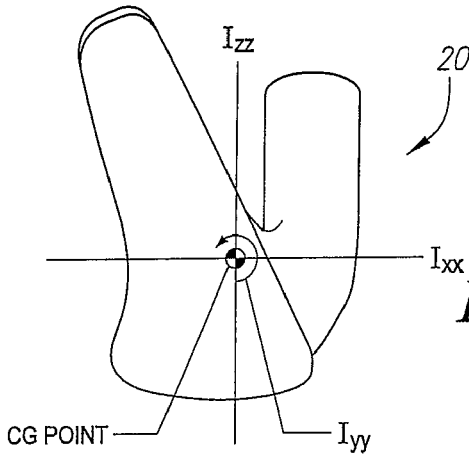
FIG. 7 is a toe side view of an iron club head illustrating the moments of inertia through the center of gravity.
Figure 8:
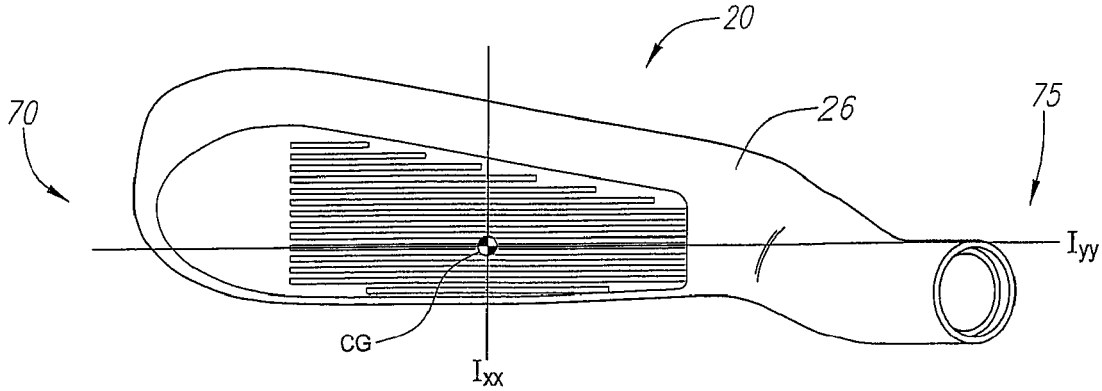
FIG. 8 is a top plan view of an iron club head illustrating the moments of inertia through the center of gravity.
Figure 9:
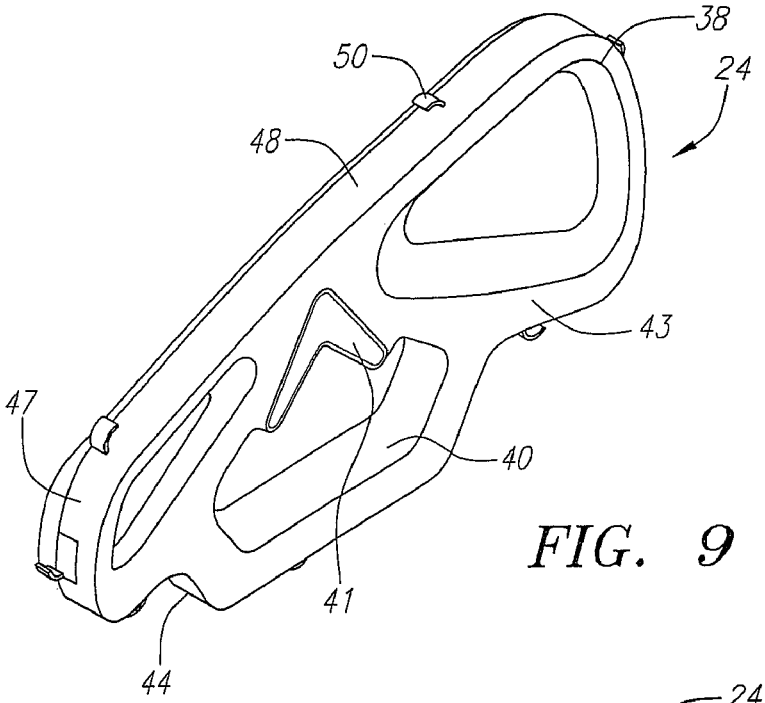
FIG. 9 is isolated perspective view of a preferred embodiment of a central member of a golf club head.
Figure 10:
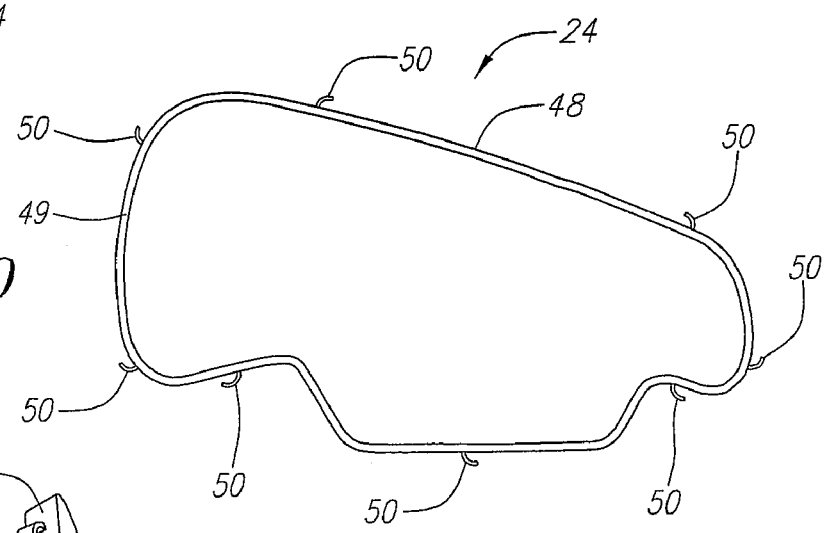
FIG. 10 is a rear plan view of the central member of FIG. 9.
Figure 11:
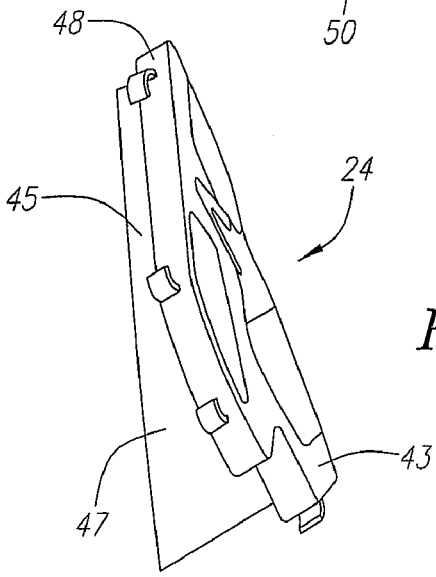
FIG. 11 is a heel side view of the central member of FIG. 9.
Figure 12:
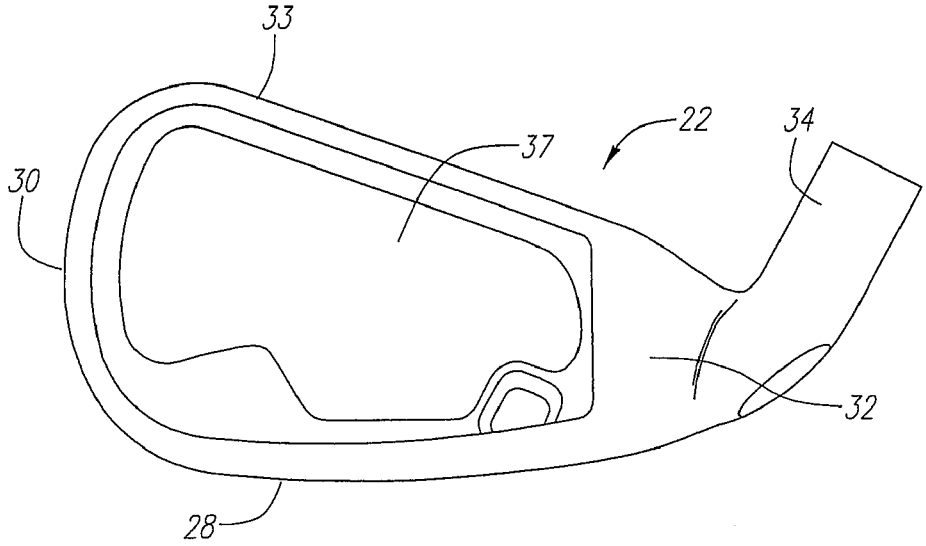
FIG. 12 is an isolated front plan view of a periphery member of a golf club head.
Figure 13:
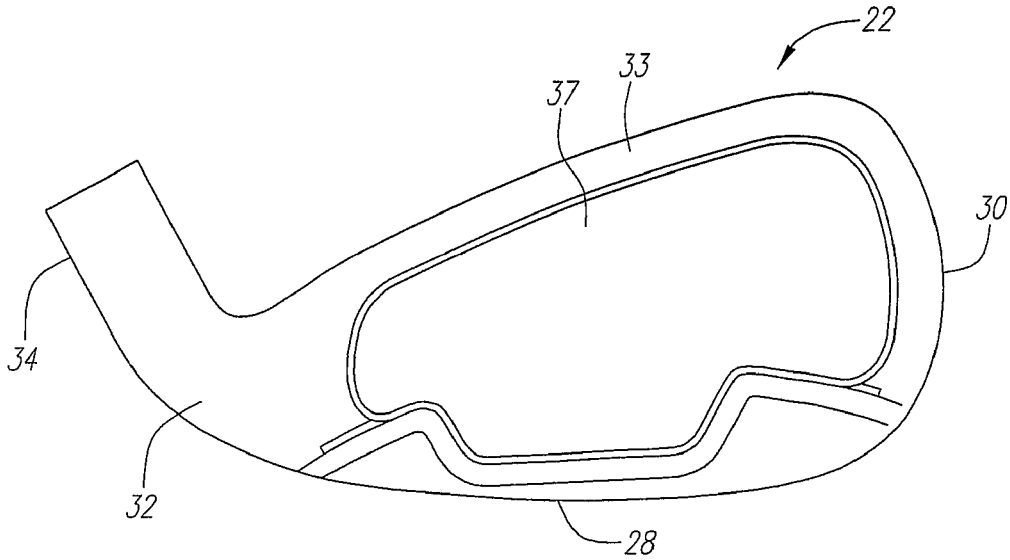
FIG. 13 is a rear plan view of the periphery member of FIG. 12.
Figure 14:
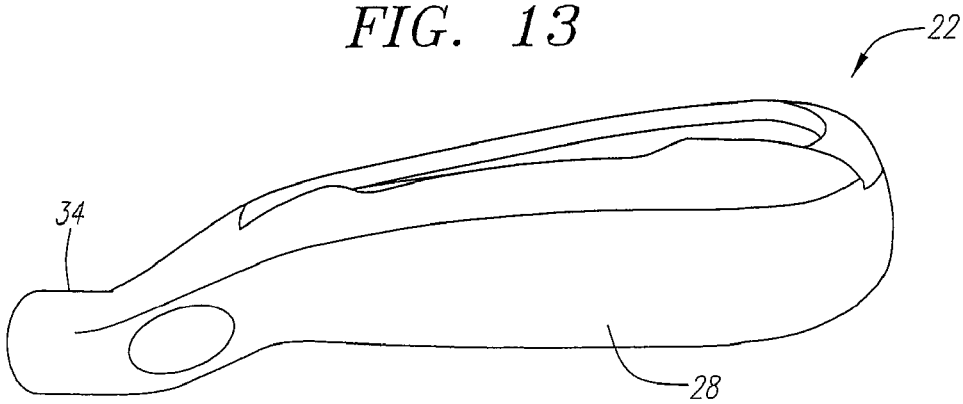
FIG. 14 is a bottom plan view of the periphery member of FIG. 12.
Figure 15:
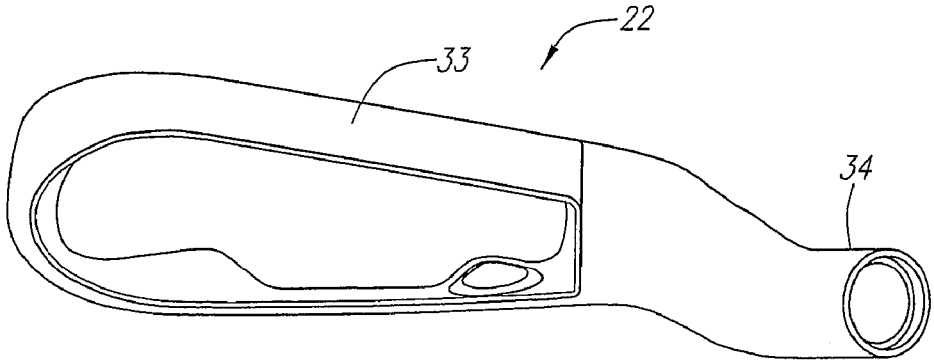
FIG. 15 is a top plan view of the periphery member of FIG. 12.
Figure 16:
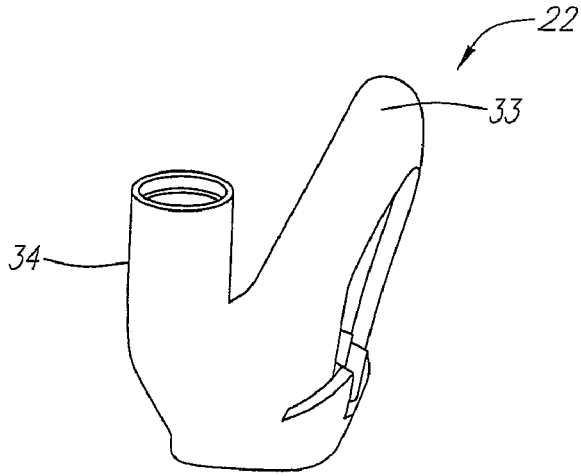
FIG. 16 is a heel side view of the periphery member of FIG. 12.
Figure 17:
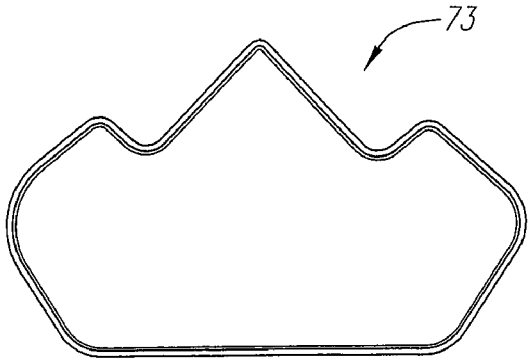
FIG. 17 is a top plan view of a medallion of a golf club head.
Figure 18:
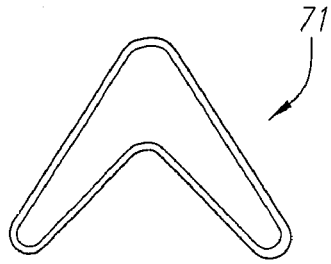
FIG. 18 is a top plan view of a medallion of a golf club head.

The sole wall 28 preferably has a cambered exterior surface, which contacts the ground during a golf swing. As shown in FIG. 6, the sole wall 28 has a width, "$W_S$", that preferably ranges from 1.00 inch to 1.75 inch, and is most preferably 1.25 inch. The sole wall 28 also has a length, "$L_S$", from a toe end to the beginning of the bore 36, which preferably ranges from 2.5 inches to 3.5 inches, and is most preferably 3.0 inches.

Figure 4:
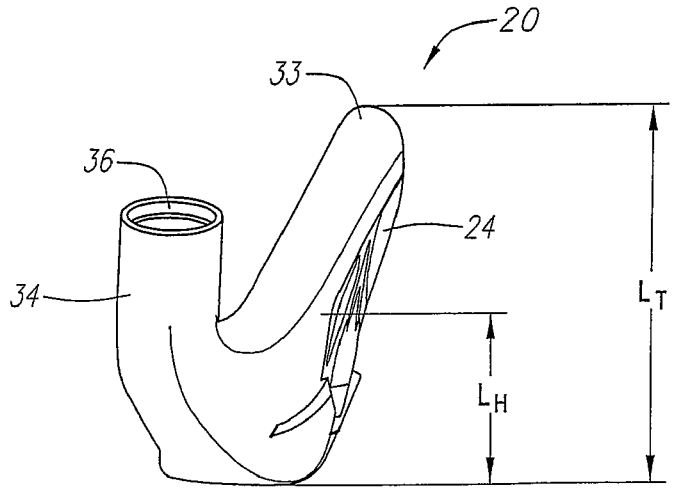
FIG. 4 is a heel side view of an iron club head.
Figure 5:
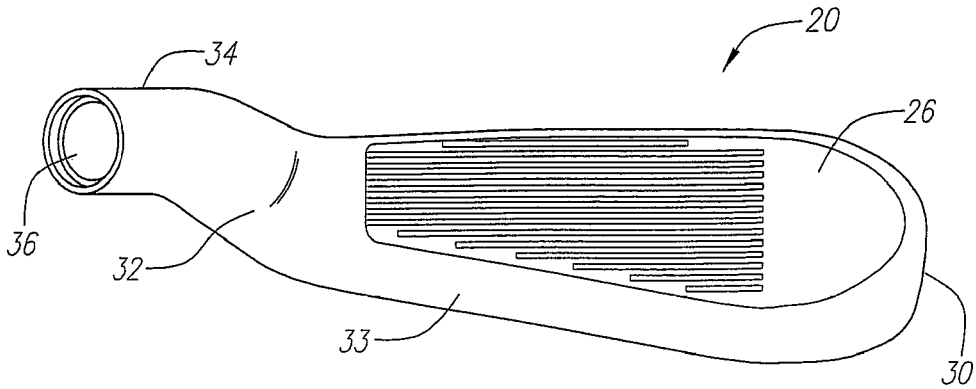
FIG. 5 is a top plan view of an iron club head.

As shown in FIG. 4, the toe wall 30 preferably has a length, "$L_T$", which preferably ranges from 1.5 inches to 2.5 inches, and is most preferably 2.0 inches. The toe wall 30 preferably has a width that tapers from a lower end to an upper end of the toe wall 30.

As shown in FIG. 4, the heel wall 32 preferably has a length, "$L_H$", which preferably ranges from 0.5 inch to 1.5 inches, and is most preferably 1.0 inch. The heel wall 32 preferably has a width that tapers from a lower end to an upper end of the heel wall 32.

In general, the periphery member 22 provides the club head 20 with a greater moment of inertia due to its relatively large mass positioned outward from the center of gravity of the club head 20. Further, mass attributable to the sole wall 28 lowers the center of gravity of the club head 20 to promote a higher trajectory during ball striking thereby creating a more forgiving iron. The periphery member 22 is preferably 15% to 50% of the volume of the club head 20 and preferably 50% to 80% of the mass of the club head 20.

The central member 24 is composed of a non-metal material. Preferred materials include bulk molding compounds, sheet molding compounds, thermosetting materials and thermoplastic materials. A preferred bulk molding compound is a resinous material with reinforcement fibers. Such resins include polyesters, vinyl esters and epoxy. Such fibers include carbon fibers, fiberglass, aramid or combinations. A preferred sheet molding compound is similar to the bulk molding compounds, however, in a sheet form. A preferred thermoplastic material is a thermoplastic polyurethane. Other thermoplastic materials include polyesters, polyethylenes, polyamides, polypropylenes, and the like.

The central member 24 is primarily a support for the face plate 26, and thus the central member should be able to withstand impact forces without failure. The central member 24 also reduces vibrations of the golf club head 20 during ball striking. The central member 24 is preferably 25% to 75% of the volume of the club head 20 and preferably 10% to 30% of the mass of the club head 20.

The central member 24 preferably has a body portion 38, a first recess 40, a second recess 41, an interior surface 42, an exterior surface 43, a sole surface 44, a top surface 45, a toe surface 46, and a heel surface 47. The recesses 40 and 41 are formed in the exterior surface 43 of the body portion 38 and may have any of a number of suitable configurations. The body portion 38 preferably tapers upward from the sole surface 44. The body portion 38 also has a perimeter 48 and a perimeter interior surface 49.

On the perimeter 48 is a plurality of tabs 50 for positioning and retaining the central member 24 within the periphery member 22. Each of the plurality of tabs 50 is preferably curved portion. The curved portion engages with the interior surface of the periphery member 22. Each of the plurality of tabs 50 is compressible for engagement of the central member 24 with the periphery member 22, and the plurality of tabs 50 assist with the centering and alignment of the central member 24. An adhesive is filled between the each of the plurality of tabs 50 for securing the central member 24 to the periphery member 22. A more thorough description of the plurality of tabs 50 is disclosed in Hehnstetter et al., U.S. Pat. No. 6,238,302 for a Golf Club Head With An Insert Having Integral Tabs, assigned to Callaway Golf Company, and hereby incorporated by reference in its entirety.

A first medallion 71 is preferably placed within the first recess 40 and a second medallion 73 is preferably placed within the second recess 41. The first and second medallions 71 and 73 are preferably utilized for swing weighting of the golf club head 20. The mass each medallion 71 and 73 preferably varies from 0.5 gram to 7 grams.

The face insert 26 is preferably composed of a low density polymer material, preferably a nylon material, a polyurethane material, a polycarbonate material or other similar injectable polymer materials. The face insert 26 alternatively is composed of a composite material such as plies of pre-preg.

A portion of the face insert 26 or the entire face insert 26 is plated to provide greater durability than an un-plated equivalent. The face insert 26 is plated on an exterior surface, an interior surface and/or a perimeter surface. In this manner, a relatively fragile face insert composed of an injectable polymer material is transformed into a very durable golf club component due to the nanocrystalline plating. A nanocrystalline plating layer 300 preferably ranges from 20 microns to 2000 microns. Preferably, the nanocrystalline material is selected from the group of nickel, nickel alloy, nickel-iron-molybdenum alloy, a nickel-iron-chromium alloy, iron alloy, iron, chromium or chromium alloy.

Figure 19:
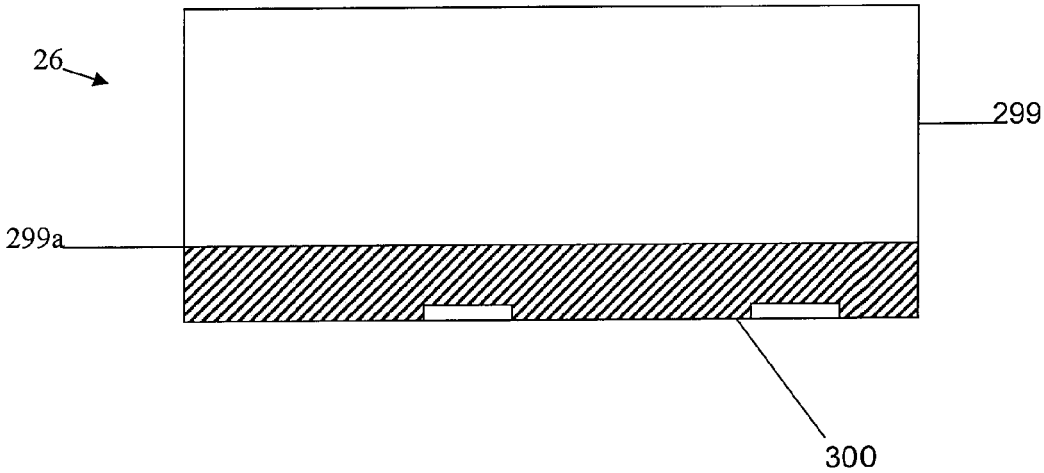
FIG. 19 is a cross-sectional view of a preferred embodiment of a face insert.

As shown in FIG. 19, an injectable polymer material base layer 299 has an exterior surface 299*a* plated with the nanocrystalline plating layer 300.

Figure 20:
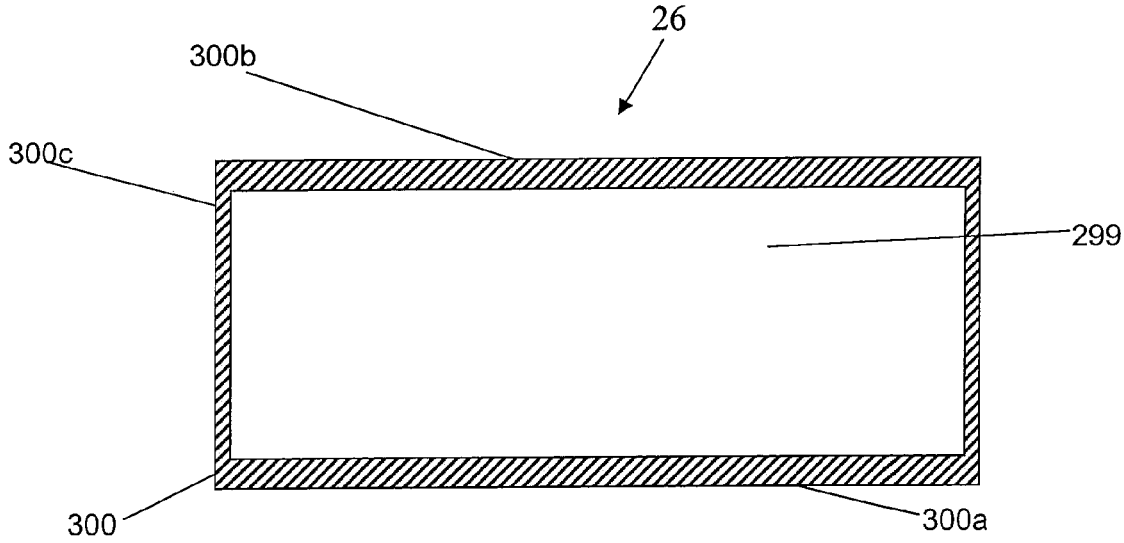
FIG. 20 is a c cross-sectional view of an alternative embodiment of a face insert.

In an alternative embodiment shown in FIG. 20, the injectable polymer material base layer 299 is encased by the plating layer 300. The plating layer 300 preferably comprises an exterior surface layer 300*a*, an interior surface layer 300*b* and a perimeter surface layer 300*c*.

A preferred plating process is electroless plating which involves plating onto a substrate by chemical reduction. Electroless platings are produced without an externally applied electric current. An alternative plating process is electrolytic plating, which is well-known and involves passing a direct current between an anode and a cathode to deposit metal or metal alloys particles, which are in an electrolyte medium, on the cathode.

Alternatively, the face insert is composed of a very thin low-density metal layer with nanocrystalline plating. Such low-density metal materials include titanium materials, stainless steel, amorphous metals and the like. Such titanium materials include pure titanium and titanium alloys such as 6-4 titanium alloy, 6-22-22 titanium alloy, 4-2 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like.

The face insert 26 has an interior surface 56, which preferably engages the interior surface 42 of the central member 24 or an adhesive placed on the interior surface 42 of the central member 24, and an exterior surface 54 which preferably has scorelines 57 thereon. The scorelines are preferably also plated with the nanocrystalline material. The face plate 26 preferably has a thickness that ranges from 0.040 inch to 0.250 inch, more preferably from 0.075 inch to 0.160 inch, and most preferably 0.125 inch.

The club head 20 preferably has a total volume that ranges from 40.0 $cm^3$ to 60.0 $cm^3$, more preferably from 45.0 $cm^3$ to 55.0 $cm^3$, and most preferably 50.8 $cm^3$ for a 5-iron golf club head 20. The club head 20 preferably has a mass that ranges from 235 grams to 300 grams, more preferably from 245 grams to 260 grams for a 5-iron golf club head 20.

The periphery member 22 preferably has a mass that ranges from 100 grams to 240 grams, more preferably from 140 grams to 200 grams, and most preferably 152 grams. The central member 24 preferably has a mass that ranges from 9 grams to 70 grams, more preferably from 15 grams to 50 grams, and most preferably 18 grams.

The face plate 26 preferably has a total volume that ranges from 4.0 $cm^3$ to 8.0 $cm^3$, more preferably from 4.5 $cm^3$ to 6.0 $cm^3$, and most preferably 5.3 $cm^3$. The face plate 26 preferably has a mass that ranges from 15 grams to 50 grams, more preferably from 20 grams to 30 grams, and most preferably 24 grams.

FIGS. 9-12 illustrate the axes of inertia through the center of gravity of the golf club head 20. The axes of inertia are designated X, Y and Z. The X axis extends from the front of the golf club head 20 through the center of gravity, CG, at the face plate 26 to the rear of the golf club head 20. The Y axis extends from the heel end 75 of the golf club head 20 through the center of gravity, CG, and to the toe end 70 of the golf club head 20. The Z axis extends from the sole wall through the center of gravity, CG, and to the top line 80.

As defined in *Golf Club Design, Fitting, Alteration & Repair,* $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 20 are preferably measured using a test frame ($X^T$, $Y^T$, $Z^T$), and then transformed to a head frame ($X^H$, $Y^H$, $Z^H$). The center of gravity of a golf club head 20 may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z-axis for the golf club head 20 preferably ranges from 2200 g-$cm^2$ to 3000 g-$cm^2$, more preferably from 2400 g-$cm^2$ to 2700 g-$cm^2$, and most preferably from 2472 g-$cm^2$ to 2617 g-$cm^2$. The moment of inertia, Iyy, about the Y-axis for the golf club head 20 preferably ranges from 400 g-$cm^2$ to 700 g-$cm^2$, more preferably from 500 g-$cm^2$ to 600 g-$cm^2$, and most preferably from 530 g-$cm^2$ to 560 g-$cm^2$. The moment of inertia, Ixx, about the X-axis for the golf club head 20 preferably ranges from 2450 g-$cm^2$ to 3200 g-$cm^2$, more preferably from 2500 g-$cm^2$ to 2900 g-$cm^2$, and most preferably from 2650 g-$cm^2$ to 2870 g-$cm^2$.

In general, the products of inertia, Iyz, Ixz and Ixy for the golf club head 20 preferably have an absolute value below 100 g-$cm^2$ for at least one and preferably two of the products of inertia Iyz, Ixz and Ixy. Products of inertia for a golf club head are disclosed in U.S. Pat. No. 6,547,676, entitled Golf Club Head That Optimizes Products Of Inertia, assigned to Callaway Golf Company, and hereby incorporated by reference in its entirety.

For comparison, the new BIG BERTHA® 5-iron from Callaway Golf Company has a moment of inertia, Izz, of 2158 g-$cm^2$, a moment of inertia, Iyy, of 585 g-$cm^2$, and a moment of inertia, Ixx, of 2407 g-$cm^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. An iron golf club head comprising:

a periphery member composed of a metal material, the periphery member defining an opening;

a central member disposed in the opening of the periphery member, the central member being composed of a first non-metal material; and a face insert composed of a second non-metal material with a nanocrystalline plating deposited on an exterior surface of the face insert, the second non-metal material having a lower density than the metal material, the face insert mounted in the opening of the periphery member and disposed over the central member, the face insert having a thickness between 0.040 inch and 0.250 inch;

wherein the golf club head has a total volume ranging from 40 $cm^3$ to 60 $cm^3$.

2. The iron golf club head according to claim 1 wherein the metal material comprises a nickel-tungsten alloy.

3. The iron golf club head according to claim 1 wherein the nanocrystalline plating has a thickness ranging from 20 microns to 2000 microns.

4. The iron golf club head according to claim 1 wherein the second non-metal material is a nylon material.

5. The golf club head according to claim 1 wherein the second non-metal material is a composite material.

6. The golf club head according to claim 1 wherein the second non-metal material is plies of pre-preg.

7. The golf club head according to claim 1 wherein the nanocrystalline plating is composed of a nickel-iron-molybdenum alloy.

8. The golf club head according to claim 1 wherein the nanocrystalline plating is composed of a nickel-iron-chromium alloy.

9. The golf club head according to claim 1 wherein the second non-metal material is selected from the group consisting of a nylon material, a composite material, a polycarbonate material and a polyurethane material.

10. An iron golf club head comprising:

a periphery member composed of a metal material, the periphery member defining an opening;

a central member disposed in the opening of the periphery member, the central member being composed of a first non-metal material; and a face insert composed of a second non-metal material with a nanocrystalline plating deposited on an exterior surface of the face insert, the nanocrystalline composed of a nickel-iron-chromium alloy, the face insert mounted in the opening of the periphery member and disposed over the central member.

* * * * *